United States Patent [19]

Livshultz et al.

[11] Patent Number: 4,900,976

[45] Date of Patent: Feb. 13, 1990

[54] MATERIAL AND ASSEMBLIES FOR TENSIONED FOIL SHADOW MASKS

[75] Inventors: Michael Livshultz, Skokie; Hua Sou Tong, Mundelein, both of Ill.

[73] Assignee: Zenith Electronics Corporation, Glenview, Ill.

[21] Appl. No.: 287,560

[22] Filed: Dec. 20, 1988

Related U.S. Application Data

[63] Continuation of Ser. No. 127,724, Dec. 2, 1987, abandoned.

[51] Int. Cl.[4] ..... H01J 29/07

[52] U.S. Cl. ..... 313/402; 420/96

[58] Field of Search ..... 313/402; 420/94, 96, 420/441, 459, 581

[56] References Cited

U.S. PATENT DOCUMENTS

| | | | |
|---|---|---|---|
| 4,210,843 | 7/1980 | Avandani | 313/403 |
| 4,593,224 | 6/1986 | Palac | 313/402 |
| 4,695,761 | 9/1987 | Fendley | 313/407 |
| 4,704,094 | 11/1989 | Stempfle | 445/30 |

FOREIGN PATENT DOCUMENTS

| | | |
|---|---|---|
| 666836 | 1/1966 | Belgium . |
| 121628 | 10/1984 | European Pat. Off. . |
| 175370 | 3/1986 | European Pat. Off. . |
| 0259979 | 3/1988 | European Pat. Off. . |
| 2217280 | 10/1973 | Fed. Rep. of Germany . |
| 197635 | 11/1983 | Japan . |
| 2174715 | 11/1986 | United Kingdom . |
| 2176050 | 12/1986 | United Kingdom . |
| 2183903 | 6/1987 | United Kingdom . |

*Primary Examiner*—Kenneth Wieder

[57] ABSTRACT

A process and material is disclosed for use in the manufacture of a tensioned mask color cathode ray tube which includes a faceplate having on its inner surface a phosphor screen, and having on opposed sides of the screen a support structure for the mask. The process comprises providing an apertured foil shadow mask characterized by being composed of a nickel-iron alloy, and securing the foil mask to the support structure while under tension and in registration with the phosphor screen. The process is further characterized by the subjection of the foil mask to a thermal cycle to partially anneal the mask to a state in which the mask has favorable magnetic and mechanical properties. The partial anneal may be accomplished as a discrete step prior to installing the mask on the support structure, or accomplished during, or as a result of, a thermal cycle in the process of sealing the tube. The material comprises a nickel-iron alloy that displays, following treatment according to the invention, characteristics that make it uniquely suited for use as a shadow mask in tensioned mask color cathode ray tubes.

13 Claims, 2 Drawing Sheets

MATERIAL AND ASSEMBLIES FOR TENSIONED FOIL SHADOW MASKS

This application is a continuation of application Ser. No. 127,724, filed Dec. 7, 1987, now abandoned.

CROSS-REFERENCE TO RELATED APPLICATIONS AND PATENTS

This application is related to but in no way dependent upon co-pending applications Ser. No. 051,896 filed May 18, 1987; Ser. No. 060,142 filed June 9, 1987; Ser. No. 832,556 filed Feb. 21, 1986, now U.S. Pat. No. 4,695,761; Ser. No. 835,845 filed Mar. 3, 1986; Ser. No. 843,890 filed Mar. 25, 1986; Ser. No. 866,030 filed Apr. 21, 1986; Ser. No. 875,123 filed June 17, 1986; Ser. No. 881,169 filed July 2, 1986; Ser. No. 948,212 filed Dec. 31, 1986; Ser. No. (5424) filed Nov. 11, 1987; and U.S. Pat. Nos. 4,210,843; 4,593,224; 4,591,344; 4,593,225; 4,595,857; 4,614,892; 4,652,791; 4,656,388; 4,672,260 and 4,678,447, all of common ownership herewith.

BACKGROUND OF THE INVENTION

This invention relates generally to flat faceplate cathode ray tubes, and more particularly to tubes of this type which have a tensioned foil shadow mask. The invention also relates to a process for the manufacture of such tubes, including the heat treating of nickel-iron alloys to provide a desired combination of mechanical and magnetic properties necessary for effective operation of tensioned foil shadow masks. Also disclosed is a shadow mask formed from an improved alloy, and a front assembly containing such a mask.

Cathode ray tubes having flat faceplates and correspondingly flat tensioned foil shadow masks are known to provide many advantages over conventional cathode ray tubes having a curved faceplate and a curved shadow mask. A chief advantage of a flat faceplate cathode ray tube with tensioned mask is a greater electron beam power-handling capability, a capability which can provide greater picture brightness. The power-handling capabilitY of tubes having the conventional curved mask is limited due to the thickness of the mask (5 to 7 mils), and the fact that it is not mounted under tension. As a result, the mask tends to expand or "dome" in picture areas of high brightness where the intensity of electron beam bombardment, and consequently the heat, is greatest. Color impurities result when the mask expands toward the faceplate and the beam-passing apertures in the mask move out of registration with their associated phosphor dots or lines on the faceplate.

A tensioned foil mask when heated acts in a manner quite different from a curved, untensioned mask. For example, if the entire mask is heated uniformly, the mask expands and relaxes the tension. The mask remains planar and there is no doming and no distortion until the mask has expanded to the point that tension is completely lost. Just before all tension is lost, wrinkling may occur in the corners. When small areas of a tensioned foil mask are differentially heated, the heated areas expand and the unheated areas correspondingly contract, resulting in only small displacements within the plane of the mask. However, the mask remains planar and properly spaced from the faceplate and, consequently, and any color impurities are unnoticeable.

The mask must be supported in tension in order to maintain the mask in a planar state during operation of the cathode ray tube. The amount of tension required will depend upon how much the mask material expands upon heating during operation of the cathode ray tube. Materials with very low thermal coefficients of expansion need only a low tension. Generally, however, the tension should be as high as possible because the higher the tension, the greater the heat incurred, and the great the electron beam current that can be handled. There is a limit to mask tension, however, as too great a tension can cause the mask to tear.

The foil mask may be tensioned in accordance with known practice. A convenient method is to thermally expand the mask by means of heated platens applied to both sides of the foil mask. The expanded mask is then clamped in a fixture and, upon cooling, remains under tension. The mask may also be expanded by exposure to infrared radiation, by electrical resistance heating, or by stretching through the application of mechanical forces to its edges.

In addition to having the composition as described herein, after heat treatment and slow cooling according to the invention, a foil formed from the alloys will have a unique combination of mechanical, thermal and magnetic properties that makes it uniquely suited for use as a tensioned foil shadow mask. The alloy, in as-cast or in treated form, must have adequate ductility to permit it to be hot or cold rolled to a foil having a thickness of less than 2 mils, preferably to a thickness of 1 mil, or even as thin as 0.5 mil. A 1 mil thick foil when rolled will typically have a reduction in area of at least 0.8 percent and preferably at least 1.0 percent elongation. To withstand the forces incident to the tensing operation, the mask material should have a yield strength above about 80 ksi and preferably above about 100 ksi (0.2 percent offset). The mask material should also be able to withstand a tension load of at least about 25 Newton/centimeter, preferably at least about 65 Newton/centimeter. The mask material should also have a thermal coefficient of expansion that is not substantially less than that of the glass of the faceplate.

In addition to the mechanical properties described, the mask material must have a particular combination of magnetic properties. In this connection, it is important that the mask material have as high a permeability as is possible while maintaining the necessary mechanical properties. The permeability should be at least about 6,000, preferably at least about 10,000, and most desirably in excess of 60,000. A maximum coercivity is desirably below about 1.0 oersted and preferably is below about 0.5 oersted.

PRIOR ART

It is well known in the manufacture of standard color cathode ray tubes of the curved-mask, curved-screen type to heattreat the shadow masks prior to their being formed into a domed shape. Conventional (non-tensioned) shadow masks are typically delivered to cathode ray tube manufacturers in a work-hardened state due to the multiple rolling operations which are performed on the steel to reduce it to the specified thickness, typically about 6 mils. In order that the masks may be stamped into a domed shape, they must be softened by use of an annealing heat treatment—typically to temperatures on the order of 700–800 degrees C. Annealing also enhances the magnetic coercivity of the masks, a desirable propertY from the standpoint of magnetic shielding of the electron beams. After stamping, and the consequent moderate work hardening of the mask which may result from the stamping operation, it is known in the prior art to again anneal the masks while in their domed shape to further enhance their magnetic shielding properties.

Foils intended for use as tensioned masks are also delivered in a hardened state—in fact, much harder than standard masks in order to provide the very high tensile strength needed to sustain the necessary high tension levels; for example, 30,000 psi, or greater. The prior art annealing process, with its relatively high annealing temperatures, would be absolutely unacceptable if applied to flat tension masks, as any extensive softening or reduction of tensile strength of the mask resulting from the process would make the material unsuited for use as a tension mask.

The disclosure of U.S. Pat. No. 4,210,843 to Avedani, of common ownership herewith, sets forth an improved method of making a conventional color cathode ray tube shadow mask; that is, a curved shadow mask having a thickness of about 6 mils, and designed for use with a correlatively curved faceplate. The method comprises providing a plurality of shadow mask blanks composed of an interstitial-free steel, each with a pattern of apertures photo-etched therein, which blanks have been cut from a foil of steel, precision cold-rolled to a full hard condition, and with a thickness of from 6 to 8 mils. A stack of blanks is subjected to a limited annealing operation carried out at a relatively low maximum temperature, and for a relatively brief period sufficient only to achieve recrystallization of the material without causing significant grain growth. Each blank is clamped and drawn to form a dished shadow mask without the imposition of vibration or roller leveling operations, and thus avoids undesired creasing, roller marking, denting, tearing or work-hardening of the blank normally associated with these operations. The end-product shadow mask, due to the use of the interstitial free steel material, has an aperture pattern of improved definition as a result of more uniform stretching of the mask blank. The annealing operation has little effect on the magnetic properties of this type of steel, and the coercivity of the material, after forming, is above 2.0 oersteds.

Prior to the present invention, there was no foil mask material available having the desired combination of mechanical and magnetic properties described herein. One material used in tensioned foil shadow mask applications in flat faceplate cathode ray tube tubes has been aluminum-killed, AISI 1005 cold-rolled capped steel, generally referred to as "AK steel." AK steel has a composition of 0.04 percent silicon, 0.16 percent manganese, 0.028 percent carbon, 0.020 percent phosphorus, 0.018 percent sulfur, and 0.04 percent aluminum, with the balance iron and incidental impurities.

(Throughout the specification and claims, all percentages are considered weight-percentages, unless otherwise indicated.)

Invar, which has a nominal composition of 36 percent nickel, balance iron, has also been suggested as a possible material for tensioned foil shadow masks. Invar however has a thermal coefficient of expansion far lower than that of the glass commonly used cathode ray tube faceplates and so is considered generally unacceptable.

A foil shadow mask is maintained under high tension within the cathode ray tube, and the mask is subjected to predetermined relatively high temperatures during tube manufacture. A process for pre-treating a metal foil shadow mask is disclosed in referent copending application Ser. No. 948,212, of common ownership herewith. The process comprises preheating the shadow mask in a predetermined cycle of temperature and time effective to minimize subsequent permanent dimensional changes in the mask that occur when it is subjected to the predetermined relatively high temperatures, but ineffective to significantly reduce the tensile strength of the mask by annealing.

The material of the masks treated according to the Ser. No. 948,212 disclosure is the aforedescribed AK steel. AK steel, while it can be formed into a fairly acceptable foil shadow mask, is deficient in certain important properties. For example, the yield strength of AK steel foil one mil thick is typically in the range of 75–80 ksi. This makes it only marginally acceptable from a strength standpoint. More importantly, AK steel has a permeability that is much lower than desired, for example, 5,000 in a 1 mil foil. Since the ability of a material to carry magnetic flux decreases with decreasing cross-section, cathode ray tubes having masks made of AK steel thinner than about 1 mil may require both internal and external magnetic shielding. With internal shielding only, the beam landing misregistration due to the earth's magnetic field, i.e., the change in beam landing position upon reversal of the axial field component, is typically 1.7 mils, which is much greater than the maximum of about 1 mil that is generally considered tolerable.

In addition, AK steel is metallurgically dirty, having inclusions, defects and dislocations which interfere with both the foil rolling process and the photo resist etching of the apertures in the foil resulting in higher scrap rates and consequently lower yields.

Another significant disadvantage of an AK steel tensioned foil shadow mask is the fact that as the tension applied is increased, the permeability decreases and the coercivity increases. Translated into picture performance, this means that as the tension of the AK foil shadow mask is increased in order to permit increased beam current and, therefore, greater picture brightness, its ability to shield the electron beams from the earth's magnetic field deteriorates, resulting in increased beam misregistration.

Finally, AK steel rusts and thus requires greater care in storage and possiblY the application of rust inhibitors. If rust does appear, it must be removed in a separate production operation, and without altering the size or shape of the apertures, or the thickness of the mask material.

OBJECTS OF THE INVENTION

It is a general object of the invention to provide an improved shadow mask material for use in a color cathode ray tubes having a tensioned foil shadow mask.

It is another general object of the invention to provide an improved process for manufacturing cathode ray tubes containing tensioned foil masks.

It is a further object of the invention to provide a cathode ray tube which includes a tensioned foil shadow mask having improved mechanical and magnetic properties.

It is yet another object of the invention to provide a process for heat treating nickel-iron alloy foil to impart to the foil certain desired mechanical and magnetic properties that make it highly suitable for use as a tensioned foil shadow mask in a cathode ray tube.

It is another object of the invention to provide a heat treating process for a foil mask material that is accomplished as a discrete step prior to tube assemblY.

It is yet another object of the invention to provide a heat-treating process for a foil mask material that is accomplished during, and as a result of, a thermal cycle in the process of sealing the tube.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

To facilitate understanding of the process and material according to the invention and their relation to the manufacture of a color cathode ray tube having a tensioned foil shadow mask, a brief description of a tube of this type and its major components is offered in following paragraphs.

Figure 1:
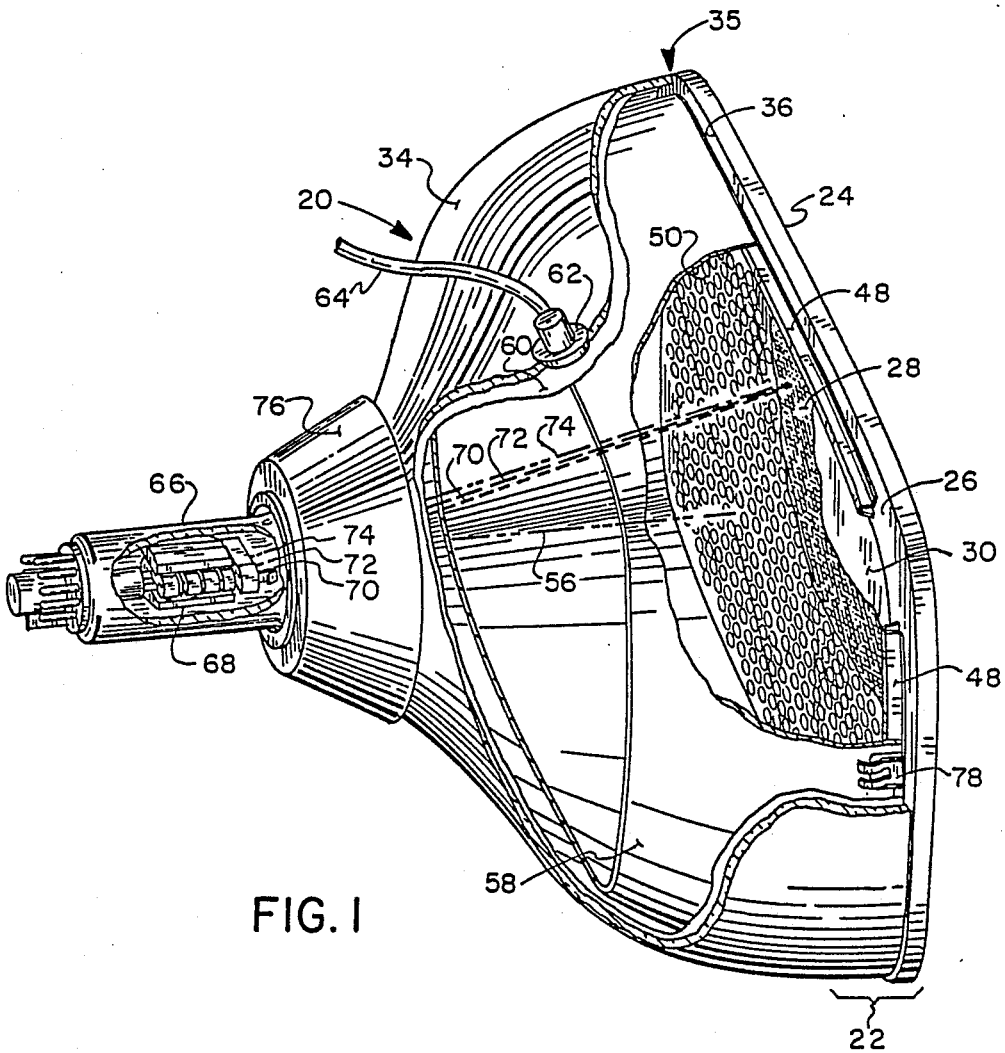
FIG. 1 is a side view in perspective of a color cathode ray tube having a flat faceplate and a tensioned foil shadow mask, with cut-away sections that indicate the location and relation of the faceplate and tensioned foil shadow mask to other major tube components.

A color cathode ray tube 20 having a tensioned foil shadow mask is depicted in FIG. 1. The faceplate assembly 22 essentially comprises a flat faceplate and a tensioned flat foil shadow mask mounted adjacent thereto. Faceplate 24, indicated as being rectangular, is shown as having on its inner surface 26 a centrally located phosphor screen 28 depicted diagrammatically as having a pattern of phosphors thereon. A film of aluminum 30 is indicated as covering the pattern of phosphors. A funnel 34 is represented as being attached to faceplate assembly 22 at their interfaces 35; the funnel sealing surface 36 of faceplate 24 is indicated as being peripheral to screen 28. A frame-like shadow mask support structure 48 is indicated as being located on opposed sides of the screen between funnel sealing surface 36 and screen 28, and mounted adjacent to faceplate 24. Support structure 48 provides a surface for receiving and mounting in tension a metal foil shadow mask 50 a Q-distance away from the screen 28. The pattern of phosphors corresponds to the pattern of apertures in mask 50. The apertures depicted are greatly exaggerated for purposes of illustration; in a high-resolution color tube for example, the mask has as many as such 750,000 apertures, with aperture diameter being on the average about 5 mils. As is well-known in the art, the foil shadow mask acts as a color-selection electrode, or "parallax barrier" which ensures that each of the beamlets formed by the three beams lands only on its assigned phosphor deposits on the screen.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete inline electron beams 70, 72 and 74 for exciting respective red-light-emitting, green-light-emitting, and blue-light-emitting phosphor elements deposited on screen 28. Yoke 76 receives scanning signals and provides for the scanning of beams 70, 72 and 74 across screen 28. An electrical conductor 78 is located in an opening in shield 58 and is in contact with conductive coating 60 to provide a high-voltage connection between the coating 60, the screen 28, and shadow mask 50. This means of electrical conduction is described and claimed in referent copending application Ser. No. 060,142 of common ownership herewith.

Two of the major components, designated as being "in-process," are depicted and described as follows. One is a shadow mask indicated diagrammatically in FIG. 2. In-process shadow mask 86 includes a central area 104 of apertures corresponding to the pattern of phosphors that is photodeposited on the screen of the faceplate by using the mask as an optical stencil. Center field 104 is indicated as being surrounded by a unperforated section 106, the periphery of which is engaged by a tensing frame during the mask tensing and clamping process, and which is removed in a later procedure.

Figure 3:
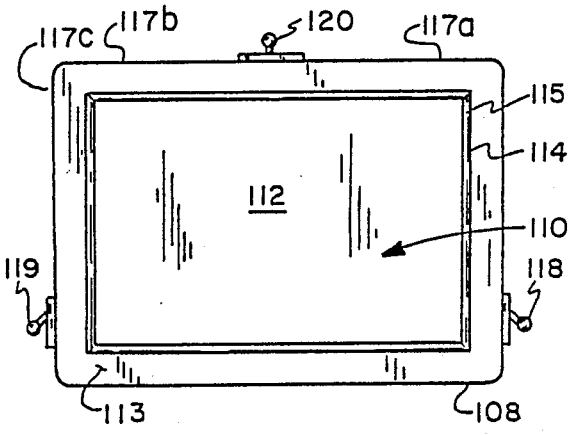
FIG. 3 is a plan view of an in-process flat glass faceplate showing a phosphor screening area and a foil shadow mask support structure secured thereto.

An in-process faceplate 108 is depicted diagrammatically in FIG. 3 as having on its inner surface 110 a centrally located screening area 112 for receiving a predetermined phosphor pattern in an ensuing operation. A funnel sealing surface 113 is indicated as being peripheral to screen 112. A frame-like shadow mask support structure 114 is depicted as being secured on opposed sides of screen 112; the structure provides a surface 115 for receiving and mounting a foil shadow mask under tension a Q-distance from the screen.

A process according to the invention essentially comprises providing an apertured foil shadow mask 86 characterized by being composed of a nickel-iron alloy, and securing the mask 86 to the mask-support structure 114 of the faceplate 108 while under tension, and in registration with the phosphor screen. The process is further characterized by subjecting the mask 86 to a thermal cYcle to partiallY anneal the mask to a state in which the mask has favorable magnetic and mechanical properties.

According to the present invention, a class of nickel-iron alloys, desirably containing minor additions of certain alloying agents, when heat-treated and cooled under controlled conditions, yield a material which, when fabricated into a thin foil, have mechanical and magnetic properties not found in known alloys that make them uniquely suited for use as tensioned foil shadow masks.

The desired properties achieved by the inventive process are as follows: The alloy foil should have a yield strength (0.2 percent offset) of at least about 80 ksi, preferably at least about 100 ksi and most desirably at least about 150 ksi in order to be able to withstand the tension loading applied to the foil when used as a tensioned foil shadow mask. This yield strength should be combined with the magnetic properties of high permeability and low coercivity. The permeability should be in excess of about 6,000, preferably in excess of about 10,000 and most desirably in excess of 100,000. The coercivity should not exceed about 2.5 oersteds, and is preferably below about 0.5 oersted.

A specific example of an alloy responsive to the heat treatment according to the invention, and fabrication into a tensioned foil shadow mask, is the known nickel-iron-molybdenum alloy sold under the tradenames Hy-Mu80, YEP-C, and MolyPermalloy. This alloy contains about 80 percent nickel, 4 percent molybdenum, with balance iron and incidental impurities. In the as-rolled, fully hardened condition, an 80Ni-4Mo-Fe foil has a high yield strength, typically 155–160 ksi, but poor magnetic properties, e.g., a permeability of less than 3,000. To impart good magnetic properties, as for use in tape recorder heads, the material is conventionally annealed at 1120 degrees C. for two to four hours followed by furnace cooling to 600 degrees C. The fully annealed alloy foil has excellent magnetic properties but poor mechanical properties. The permeability may be as high as 300,000. However, the yield strength is in the range of 20–40 ksi, making this alloy, when fully annealed, clearly unsuited for use as a tensioned foil shadow mask.

However, when the 80Ni-4Mo-Fe alloy foil is partially annealed according to the inventive process, it unexpectedly displays properties which make it superior as a material for the fabrication of tensioned foil shadow masks. As a result of this cycle of heating and cooling according to the invention, the mechanical properties of the alloy are substantially retained while its magnetic properties are improved to a degree necessary for use as a foil shadow mask.

Surprisingly, it has been found that the magnetic properties of the 80Ni-4Mo-Fe foil, when treated in accordance with this invention, actually improve, and improve very significantly, when the foil is placed under tension. For example, after heat treating and conditioning according to the invention, an untensioned 80Ni-4Mo-Fe foil having a thickness of 1 mil has a permeability of 60,000. When that same foil is placed under a tension of about 60 Newton/centimeter, its permeability is increased to 100,000. It is to be noted that the same material exhibits no significant permeability change under tension when in its conventional full hard state. As a result of the increased permeability, the amount of beam misregistration due to the earth's magnetic field of an 80Ni-4Mo-Fe foil 1 mil thick, when processed according to the invention, is far less than that of an AK-steel foil of 1 mil thickness.

With regard to the alloy composition, a nickel-iron alloy is provided comprising between about 30 and about 85 weight-percent of nickel, between about 0 and 5 weight-percent of molybdenum, between 0 and 2 weight-percent of one or more of vanadium, titanium, hafnium, and niobium, with the balance iron and incidental impurities; e.g., carbon, chromium, silicon, sulfur, copper and manganese. Typically, the incidental impurities combined do not exceed 1.0 percent. Preferably, the alloy may comprise between about 75 and 85 weight-percent of nickel, between about 3 and 5 weight-percent of molybdenum, with the balance iron and incidental impurities. In one specific example, the alloy may comprise about 80 weight-percent nickel, about 4 weight-percent molybdenum, with the balance iron and incidental impurities.

Mask Heat-Treatment Before Installation in Tube

A partial anneal of the preferred material may be accomplished according to the invention as a discrete step prior to installing the mask on the mask support structure secured to the faceplate. To achieve the desired combination of mechanical and magnetic properties, the foil must be subjected to a specified procedure of heat treating and slow cooling according to the invention to provide a foil having the desired combination of magnetic and mechanical properties.

Figure 2:
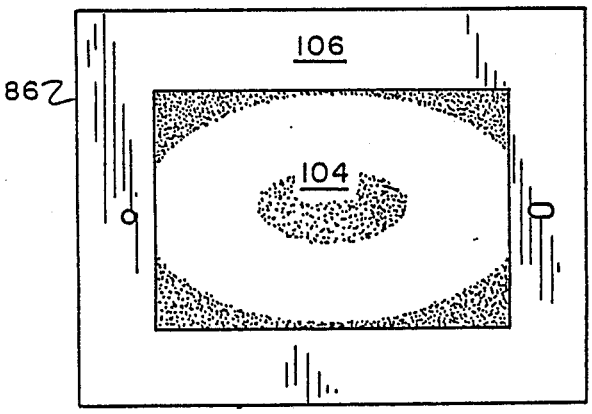
FIG. 2 is a plan view of an in-process foil shadow mask.

In a typical process according to the invention, a group of 12 full-hard, apertured masks of the configuration shown by FIG. 2 are stacked for insertion into an oven. The process according to the invention is characterized by subjecting each of the stacked masks to a thermal cycle to partially anneal the mask to produce favorable magnetic and mechanical properties, comprising heating the mask to a temperature above about 400 degrees C. and below that temperature at which the mask alloy substantially forms a solid solution for a period of at least about 30 minutes, preferably about at least 45 minutes, and slowly cooling the mask from that temperature to the temperature at which the alloy from which the mask is formed is substantially recrystallized at a cooling rate of less than about 5 degrees C. per minute, and preferably less than about 3 degrees C. per minute; and then securing the mask to a mask support structure affixed to or integral with the faceplate while the mask is under tension and in registration with the phosphor screen. For example, the mask may be heated to a temperature of between about 400 degrees C. and about 700 degrees C. for a period between about 30 minutes and about 60 minutes. The mask is then slowly cooled from that temperature to the temperature at which the material of the masks is substantially recrystallized at a cooling rate of less than about 5 degrees C. per minute, preferably less than 3 degrees C. per minute, and most desirably at a rate of between about 2 degrees C. and about 3 degrees C. per minute. Longer heat treatments are permissible but do not appear to result in an improvement in properties. Heat treating at the indicated temperatures followed by air cooling or cooling at rates above 5 degrees C. per minute resulted in foils having undesirably poor mechanical properties. While not wishing to be bound by any particular theory, it is believed that the disclosed heat treatment, which is at temperatures well below annealing temperatures, followed by slow cooling, results in the long range ordering of $Ni_3Fe$ as intragranular and intergranular precipitates.

The heating of the assembly and the foil, and the slow rate of cooling of the assembly and the foil according to the invention, is effective to partially anneal the foil mask and produce a yield strength in excess of 80 ksi, a permeability above about 6,000, a coercivity below about 2.5 oersteds, and a thermal coefficient of expansion that is not less than about that of the faceplate (glass). Following the process as described, the mask may well have a yield strength above about 150 ksi, a permeability above about 10,000, and a coercivity below about 1.0. The foil is able to withstand tension loads in excess of about 65 Newton/centimeters, and possibly above 75 Newton/centimeter.

Mask Heat-Treatment During Frit Cycle

The heat treatment and slow cooling treatment of the masks described in following paragraphs closely approximates the processing steps in frit sealing cathode ray tube, and the sealing of the funnel and faceplate in the manufacturing process.

Subsequent to the initial implementation of the inventive process, it was determined that the heating and cooling conditions to which the tensioned mask is subjected during a frit cycle are such that a substantial improvement in the properties of the described alloy is obtained without requiring the separate heat treatment and slow cooling process described in the foregoing. The properties of the tensioned foil mask are not as good as those obtained when the mask material is heated to the more desirable temperature of 500–600 degrees C. However, where the brightness and resolution demanded of the cathode ray tube are not as high, it has been determined that the slow heating of an in-place 80Ni-4Mo-Fe tensioned mask to about 435 degrees C. in the frit cycle, followed by slow cooling at a rate of less than about 5 degrees C. per minute, preferably between about 2 degrees and about 3 degrees C. per minute, which is the cooling rate in the frit cycle, provides a finished mask having the desired mechanical and magnetic properties.

For example, when untreated tensioned foil masks are placed under a tension of 30 Newton/centimeter, and run through the frit cycle, a yield strength of between about 150 ksi and about 160 ksi and a permeability of between about 60,000 and about 100,000, and a coercivity of below about 0.4 oersted, is obtained. The beam misregistration is somewhat higher than that obtained when the foil is separately heat treated, but still below the desired limit.

So a partial anneal according to the invention may also be accomplished during, and as a result of, a thermal cycle in the process of sealing the tube. The process is described in following paragraphs.

As indicated in FIG. 3, a shadow mask support structure 114 is secured on the inner surface 110 of faceplate 108 between the peripheral sealing area, noted as being the funnel sealing surface 113, and the screening area 112. The mask support structure 114 provides a surface 115 for receiving and supporting a foil shadow mask in tension. The mask support structure 114 may comprise, by way of example, a stainless steel metal alloy according to the disclosure of referent copending application Ser. No. 832,556, or alternately, a ceramic structure according to the disclosure of referent copending application Ser. No. 866,030. Attachment of the support structure is preferably by means of a devitrifying frit.

A nickel iron alloy is provided comprising between about 30 and about 85 weight-percent of nickel, between about 0 and 5 weight-percent of molybdenum, between 0 and 2 weight-percent of one or more of vanadium, titanium, hafnium, and niobium, with the balance iron and incidental impurities; e.g., carbon, chromium, silicon, sulfur, copper and manganese. Typically, the incidental impurities combined do not exceed 1.0 percent. Alternately and according to the invention, the alloy may comprise between about 75 and 85 weight-percent of nickel, between about 3 and 5 weight-percent of molybdenum, with the balance iron and incidental impurities. Preferably, the alloy may comprise about80 weight-percent nickel, about 4 weight-percent molybdenum, with the balance iron and incidental impurities.

The alloy according to the invention is formed into a foil having a thickness of about 0.001 inch or less.

A central area 112 of the foil is apertured to form a foil mask 108 consonant in dimensions with the screening area 112 for color selection. Aperturing of the mask can be accomplished by a photo-etching process in which a light-sensitive resist is applied to the foil. The resist is hardened by exposure to light except in those areas where apertures are defined. The exposed metal defining the apertures is then etched way.

The foil mask is then tensed in a tensing frame to a tension of at least about 25 Newton/centimeters A tensing frame suitable for use in tensing a mask foil, and the process for tensing, is fully described and claimed in referent copending application Ser. No. 051,896, of common ownership herewith. In essence, the foil may be expanded by enclosing it between two platens heated to 360 degrees C for one minute, clamped in the tensing frame, and air cooled it to provide a tensioned foil having a greater length and width than the faceplate to which it will be secured. A pattern of red-light-emitting, green-light-emitting, and blue-light-emitting phosphor deposits are sequentially photoscreened on screening area 112. The photoscreening process includes repetitively registering the foil to the phosphor screening area by registering the tensing frame with the faceplate. The means of registration is fully set forth in the referent '896 application.

The foil comprising the mask 86 is secured to the mask support structure 114, with the apertures of the mask in registration with the pattern of phosphor deposits on screening area 112. The means of securement of the mask to the mask support structure may be by welding with a laser beam, with the excess mask material removed by the same beam, as fully described and claimed in referent copending application Ser. No. 058,095, of common ownership herewith. Inasmuch as the faceplate 108 and the tensioned foil shadow mask 86 are rigidly interconnected by their mutual attachment to the mask support structure, the thermal coefficient of expansion of the alloy foil must approximate that of the faceplate, which is typically a glass having a coefficient of expansion of between about $12\times10^{-6}$ and about $14\times10^{-6}$ in/in/ degrees C. This is necessary due to the relatively high temperatures to which the faceplate and mask are subjected during the cathode ray tube manufacturing process. A coefficient of expansion somewhat greater than that of the faceplate can be tolerated, but a coefficient of expansion substantially less than that of the faceplate is to be avoided as this may lead to mask failure during the manufacturing process.

Figure 4:
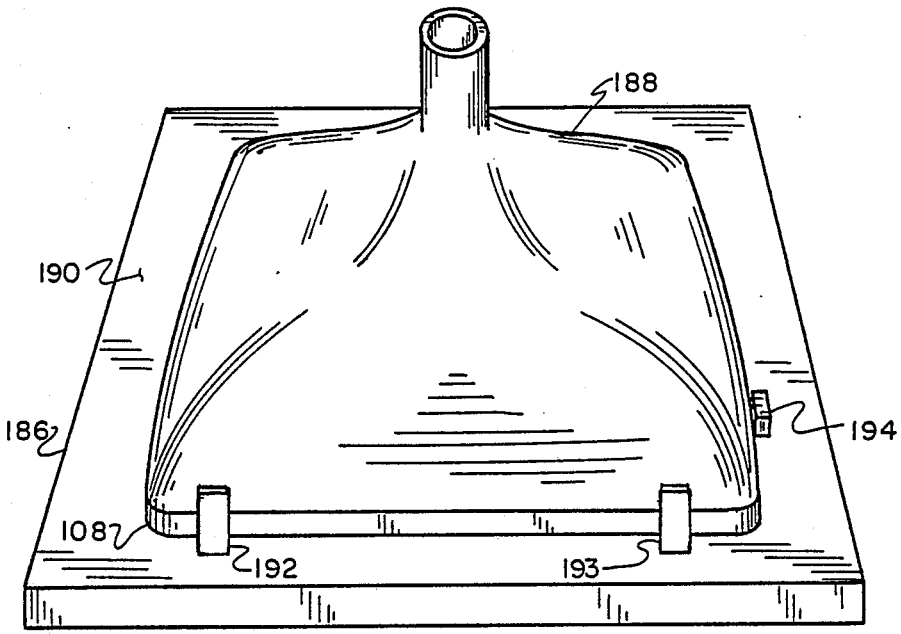
FIG. 4 is a perspective view of a funnel referencing and fritting fixture, with a funnel and the faceplate to which it is to be attached shown as being mounted on the fixture.
Figure 5:
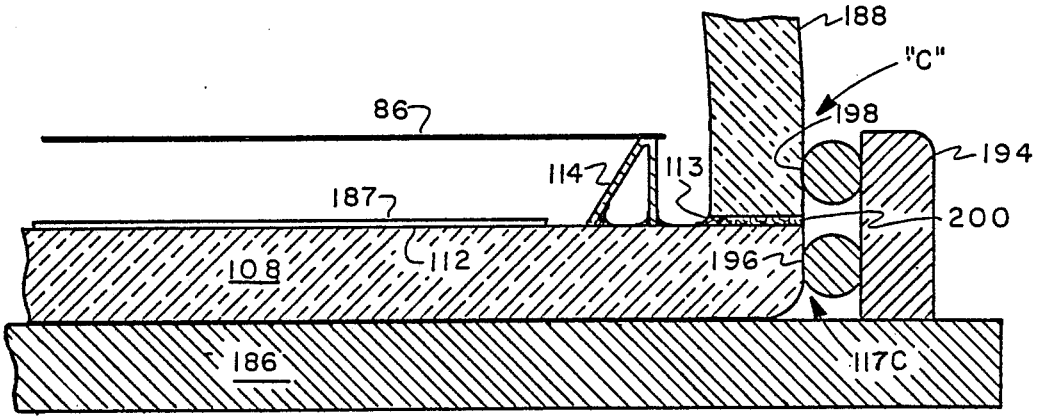
FIG. 5 is partial detail view in section and in elevation depicting the attachment of a funnel to a faceplate.

FIGS. 4 and 5 depict the use of a funnel referencing and fritting fixture 186 for mating of a faceplate 108 with a funnel 188 to form a faceplate-funnel assembly. Faceplate 108 is indicated as being installed face down on the surface 190 of fixture 186. Funnel 188 is depicted as being positioned thereon and in contact with funnel sealing surface 113, noted as being peripheral to screening area 112 on which is deposited a pattern of phosphors 187 as a result of the preceding screening operation. With reference to FIG. 4, three posts 192, 193 and 194 are indicated as providing for alignment of the funnel and faceplate. FIG. 5 depicts details of the interface between post 194, the faceplate 108, and funnel 188. Flat 117*c* on faceplate 108 is shown as being in alignment with reference area "c" on funnel 188. Shadow mask 86, noted as being in tension, is depicted as being mounted on shadow mask support structure 114; this configuration of a shadow mask support structure is the of U.S. Pat. No. 4,686,416 of common ownership herewith.

Post 194 is shown as having two reference points 196 and 198 for locating the funnel 188 with reference to the faceplate 108. The reference points preferably comprise buttons of carbon as they must be immune to the effects of the elevated oven temperature incurred during the frit cycle. The use of funnel referencing and fritting fixture in the registration a faceplate and a funnel is fully described in referent copending application Ser. No. (5452).

A devitrifiable frit in paste form is applied to the peripheral sealing area of the faceplate 108, noted as being funnel sealing area 113, for receiving funnel 188. The faceplate 108 is then mated with the funnel 188 to form a faceplate-funnel assembly. The frit, which is indicated by reference No. 200 in FIG. 5, may for example comprise frit No. CV-130, manufactured by Owens-Illinois, Inc. of Toledo, Ohio.

The faceplate-funnel assembly is then heated to a temperature effective to devitrify the frit and permanently attach the funnel to the faceplate, after which the assembly is cooled. The process of fusing of the funnel to the faceplate is generally carried out under conditions referred to as the frit cycle. In a typical frit cycle, the faceplate, to which the tensioned foil mask is adhered, and funnel are slowly heated to 435 degrees C., then cooled to room temperature or slightly thereabove over a period of three to three-and-one-half hours. The foil must be cooled to the temperature at which the alloy is substantially recrystallized at a cooling rate of less than about 5 degrees C. per minute, preferably less than about 3 degrees C. per minute and most desirably at a rate of between about 2 degrees C. and about 3 degrees C. per minute.

The heating of the assembly and the foil, and the slow rate of cooling of the assembly and the foil according to the invention and during the frit cycle, is effective to partially anneal the foil mask and produce the desired mechanical and magnetic properties set forth in the foregoing.

Test results in support of the concept according to the invention are summarized by the following examples.

EXAMPLE I

An 80Ni-4Mo-Fe cold-rolled foil is 1 mil thick. In the as received condition, the foil has a permeability of 3,000, a coercivity of 2.2 oersteds and a yield strength of 156 ksi.

The foil is heat treated in a dry hydrogen atmosphere at 500 degrees C. for 60 minutes and is then cooled to 200 degrees C. at a cooling rate of 3 degrees C. per minute. The heat treatment results in a foil having a yield strength of 192 ksi, a permeability of 60,000, a coercivity of 0.31 oersteds, and a coefficient of expansion of $13\times10^{-6}$ in/in/ degrees C.

EXAMPLE II

A 42Ni-Fe cold-rolled foil 1 mil thick may be used. In the as-received condition, the foil will have a permeability of 3,000, a coercivity of 4.0 oersteds and yield strength of 110 ksi.

The foil may be heat treated at 600 degrees C. in a dry hydrogen furnace for two hours and cooled to below 200 degrees C. at a cooling rate of 2 degrees C. per minute. The heat-treated and slow-cooled foil will have a permeability of 9,000, a coercivity of 1.1 oersteds and a yield strength of 80 ksi.

EXAMPLE III

A 49Ni-Fe foil 1 mil thick in the as-received condition, will have a permeability of 3,200, a coercivity of 4.2 oersteds and a yield strength of 115 ksi After heat treatment and slow cooling in accordance with Example I, the foil will have a permeability of 10,000, a coercivity of 0.4 oersteds and a yield strength of 85 ksi.

EXAMPLE IV

A 49Ni-4Mo-Fe foil 1 mil thick in the as-received condition will have physical and magnetic properties similar to the foil of Example I. After heat treating and slow cooling, in accordance with Example I, the foil will have a permeability of 20,000, a coercivity of 0.3 oersteds and a yield strength of 160 ksi.

EXAMPLE V

A 79Ni-2Mo-IV-Fe foil 1 mil thick in the as-received condition will be expected to have physical and magnetic properties similar to the foil of Example I. The foil may be heat-treated and slow-cooled in accordance with Example I. After heat treatment and slow cooling, the foil will be expected to have a permeability of 30,000, a coercivity of 0.30 oersteds and yield strength of 160 ksi.

EXAMPLE VI

A 79Ni-2V-1Ti-Fe foil 1 mil thick in the as-received condition will be expected to have physical and magnetic properties similar to the foil of Example I. The foil may be heat-treated and slow cooled in accordance with Example I, after which the foil will be expected to have a permeability above 30,000, a coercivity of 0.30 oersteds, and a yield strength of 170 ksi.

EXAMPLE VII

A 79Ni-4Mo-Fe foil 1 mil thick in the as-received condition will be expected to have physical and magnetic properties similar to the foil of Example I, after heat-treating and slow cooling through the conventional frit cycle. The frit cycle comprises an open furnace with a peak temperature of about 435 degrees C. The total time duration for the sample to pass through from the entry of the furnace to the outlet is about 3½ hours. The foil is expected to have a permeability of about 60,0000, a coercivity of about 0.4 oersteds, and a yield strength of about 155 ksi.

A foil shadow mask according to the invention for use in a tensioned foil color cathode ray tube, or a faceplate assembly for such a tube, is formed from an alloy comprising between about 30 and about 85 weight-percent nickel, between about 0 and 5 weight-percent molybdenum, between 0 and 2 weight-percent of one or more of vanadium, titanium, hafnium, and niobium, the alloy having a yield strength in excess of 80 ksi, a permeability above about 6,000, a coercivity below about 2.5 oersteds and a thermal coefficient of expansion that is not less than about that of the faceplate. Further, the mask may be under a tension of at least about 25 Newton/centimeters when the tube is at ambient temperature. The alloy according to the invention may have a yield strength above about 150 ksi, a permeability above about 10,000, and a coercivity below about 1.0. Further with regard to the content of the alloy of the mask, the content may comprise between about 75 weight-percent and about 85 weight-percent of nickel, between about 3 weight-percent and about 5 weight-percent of molybdenum, with the balance iron and incidental impurities; and preferably, the content may comprise about 80 weight-percent of nickel, about 4 weight-percent of molybdenum, with the balance iron and incidental impurities.

While particular embodiments of the invention have been shown and described, it will be readily apparent to those skilled in the art that changes and modifications may be made in the inventive means and process without departing from the invention in its broader aspects, and therefore, the purpose of the appended claims is to cover all such changes and modifications as fall within the true spirit and scope of the invention.

What is claimed is:

1. A foil shadow mask for use in a tensioned foil color cathode ray tube, said foil mask being formed from an alloy comprising between about 30 and about 85 weight-percent nickel, between about 3 and about 5 weight-percent molybdenum between 0 and about 2 weight-percent of an alloying agent selected from the group consisting of vanadium, titanium, hafnium, niobium and mixtures thereof, balance iron and incidental impurities, said alloy having a coefficient of expansion that is not less than about that of the faceplate of the cathode ray tube.

2. A foil shadow mask for use in a tensioned foil color cathode ray tube, said foil mask being formed from an alloy comprising between about 30 and about 85 weight-percent nickel, between about 3 and about 5 weight-percent molybdenum, between 0 and about 2 weight-percent of an alloying agent selected from the group consisting of vanadium, titanium, hafnium, niobium and mixtures thereof, balance iron and incidental impurities, said alloy having a yield strength in excess of about 80 ksi, a permeability above about 6,000, a coercivity below about 2.5 oersteds and a thermal coefficient of expansion that is not less than about that of the faceplate of the cathode ray tube.

3. The shadow mask according to claim 2 wherein said mask is under a tension of at least about 25 Newton-centimeters at ambient temperature.

4. The shadow mask according to claim 2 wherein said alloy has a yield strength above about 150 ksi, a permeability above about 10,000, and a coercivity below about 1.0 oersted.

5. The shadow mask according to claim 2 wherein said alloy comprises between about 75 weight-percent and about 85 weight-percent of nickel, between about 3 weight-percent and about 5 weight-percent of molybdenum, with the balance iron and incidental impurities.

6. The shadow mask according to claim 2 wherein said alloy comprises about 80 weight-percent of nickel, about 4 weight-percent of molybdenum, with the balance iron and incidental impurities.

7. A cathode ray tube front assembly comprising a flat faceplate and a tensioned flat foil shadow mask mounted adjacent thereto, said mask being formed from an alloy comprising between about 30 and about 85 weight-percent nickel, between about 3 and about 5 weight-percent molybdenum, between 0 and about 2 weight-percent of an alloying agent selected from the group consisting of vanadium, titanium, hafnium, niobium and mixtures thereof, with the balance iron and incidental impurities, said alloy having a coefficient of expansion that is not less than about that of said faceplate.

8. A cathode ray tube front assembly comprising a flat faceplate and a tensioned flat foil shadow mask mounted adjacent thereto, said mask being formed from an alloy comprising between about 30 and 85 weight-percent nickel, between about 3 and about 5 weight-percent molybdenum, between 0 and about 2 weight-percent of an alloying agent selected from the group consisting of vanadium, titanium, hafnium, niobium and mixtures thereof, with the balance iron and incidental impurities, said alloy having a yield strength in excess of about 80 ksi, a permeability above about 6,000, a coercivity below about 2.5 oersteds, and a thermal coefficient of expansion that is not less than about that of said faceplate.

9. A cathode ray tube front assembly comprising a flat faceplate and a tensioned flat foil shadow mask adjacent thereto, said mask being formed from an alloy comprising between about 30 and about 85 weight-percent nickel, between about 3 and about 5 weight-percent molybdenum, between 0 and about 2 weight-percent of an alloying agent selected from the group consisting of vanadium, titanium, hafnium, niobium and mixtures thereof, with the balance iron and incidental impurities, said alloy having a yield strength in excess of about 80 ksi, a permeability above about 6,000, a coercivity below about 2.5 oersteds, and a thermal coefficient of expansion that is not less than about that of said faceplate, said mask being under a tension of at least about 25 Newton-centimeters when said front assembly is at ambient temperature.

10. A cathode ray tube front assembly in accordance with claim 8 wherein said alloy comprises between about 75 and about 85 weight-percent nickel, between about 3 and about 5 weight-percent molybdenum, with the balance iron and incidental impurities.

11. A cathode ray tube front assembly in accordance with claim 10 wherein said alloy comprises about 80 weight-percent nickel and about 4 weight-percent molybdenum, with the balance iron and incidental impurities.

12. A color cathode ray tube having a front assembly comprising a flat faceplate and a tensioned flat foil shadow mask mounted adjacent thereto, said mask being formed from an alloy comprising between about 75 and about 85 weight-percent nickel, between about 3 and 5 weight-percent molybdenum, with the balance iron and incidental impurities, said alloy having a coefficient of expansion that is not less than about that of the faceplate of the cathode ray tube.

13. A color cathode ray tube in accordance with claim 12 wherein said alloy comprises about 80 weight-percent nickel and about 4 weight-percent molybdenum with the balance iron and incidental impurities.

* * * * *